US005662481A

United States Patent [19]

Wright

[11] Patent Number: 5,662,481

[45] Date of Patent: Sep. 2, 1997

[54] CONNECTOR AND CONNECTOR KIT

[75] Inventor: John O. Wright, York, Pa.

[73] Assignee: Osram Sylvania Inc., Danvers, Mass.

[21] Appl. No.: 614,557

[22] Filed: Mar. 13, 1996

[51] Int. Cl.[6] ..... H01R 9/09

[52] U.S. Cl. ..... 439/63; 439/581; 439/916

[58] Field of Search ..... 439/63, 581, 916, 439/668, 675, 848, 580, 607, 578

[56] References Cited

U.S. PATENT DOCUMENTS 5,547,400 8/1996 Wright ..... 439/63

5,562,506 10/1996 Wright ..... 439/675

*Primary Examiner*—Khiem Nguyen

*Assistant Examiner*—Yong Ki Kim

*Attorney, Agent, or Firm*—William H. McNeill

[57] ABSTRACT

A connector and connector kit is provided which includes an insulative housing, a conductive shell and a contact. When assembled, the contact and conductive shell are contained in the insulative housing. In particular, the conductive shell includes one segment which is positioned in a cavity which extends into one surface of the insulative housing, and another segment which extends out of such cavity and into a recess provided at such surface. The contact is positioned in a bore which extends into the insulative housing from a housing end to the cavity.

20 Claims, 4 Drawing Sheets

CONNECTOR AND CONNECTOR KIT

TECHNICAL FIELD

The present invention relates to a connector and a connector kit. The present invention is particularly useful in providing an antenna connector assembly including the connector of the present invention and an antenna cable.

BACKGROUND ART

A typical antenna connector for an antenna cable such as those used in the automobile industry for radios includes a male connector generally in the form of a plug and a female connector generally in the form of a ferrule which forms a socket. In use, the male connector is plugged into the female connector to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. In such prior art devices inadvertent axial and/or rotational movement of the male connector body relative to the female connector body makes providing a satisfactory electrical connection difficult. In addition, the lack of satisfactory tactile feedback makes it difficult to know when a suitable connection has been made.

DISCLOSURE OF THE INVENTION

It is, therefore, an object of the present invention to provide a connector wherein a male connector body does not inadvertently move in a rotational and/or an axial direction relative to a female connector body.

It is another object of the present invention to provide a connector which provides tactile feedback when connected to another connector.

A further object of the present invention is to provide a connector having a conductive shell contained within an insulative housing wherein the shell does not move in a rotational and/or an axial direction relative to the housing.

Another object of the present invention is to provide a connector which allows for effecting an improved connector assembly.

Yet a further object of the present invention is to provide a relatively simple connector, the components of which may be in kit form.

This invention achieves these and other objects, in one aspect of the invention, by providing an assembled connector the components of which comprise an insulative housing, a conductive shell and a contact. A connector kit is also provided which includes each of these connector components. The insulative housing of the present invention includes a first surface, an opposite second surface, and a cavity extending into the insulative housing from the first surface towards the opposite second surface. The cavity extends in the direction of a longitudinal axis of the housing from a first end of the housing towards an opposite second end of the housing. A bore extends into the housing in the direction of the longitudinal axis from the opposite second end towards the first end, the bore opening into the cavity. The first surface comprises at least one slot which extends in the direction of the longitudinal axis and is positioned between the opposite second end and the cavity. The conductive shell of the present invention comprises a first segment and a second segment extending from the first segment. The first segment is positioned in the cavity and the second segment extends out of the cavity and into the at least one slot. The contact of the present invention comprises a first portion and second portion extending from the first portion. The first portion is positioned in the bore and the second portion extends from the bore at the opposite second end of the housing.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
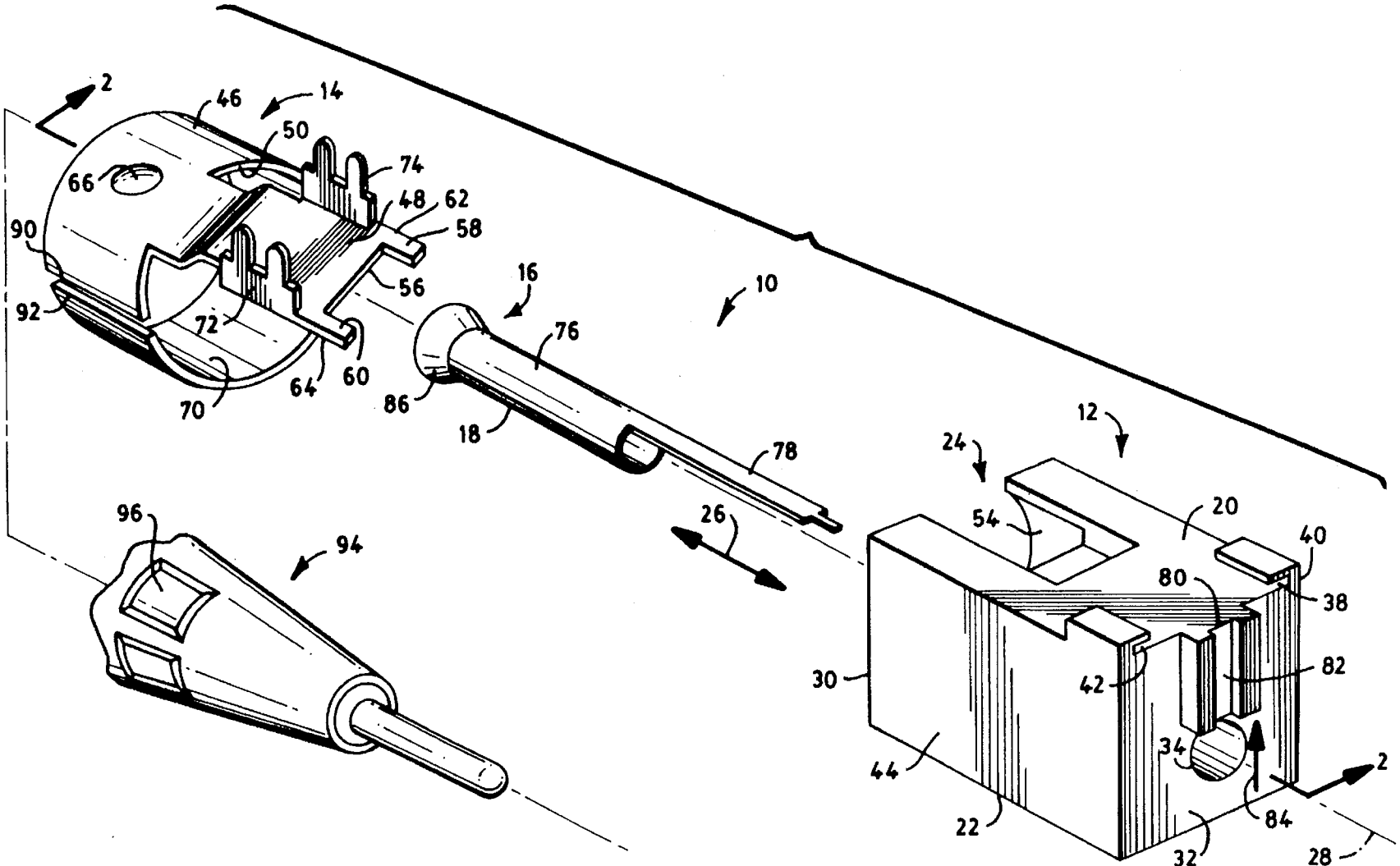
FIG. 1 is an exploded perspective view of one embodiment of the present invention depicting the components of a connector kit of the present invention and their assembled relationship as a connector of the present invention for use with a mating connector.
Figure 2:
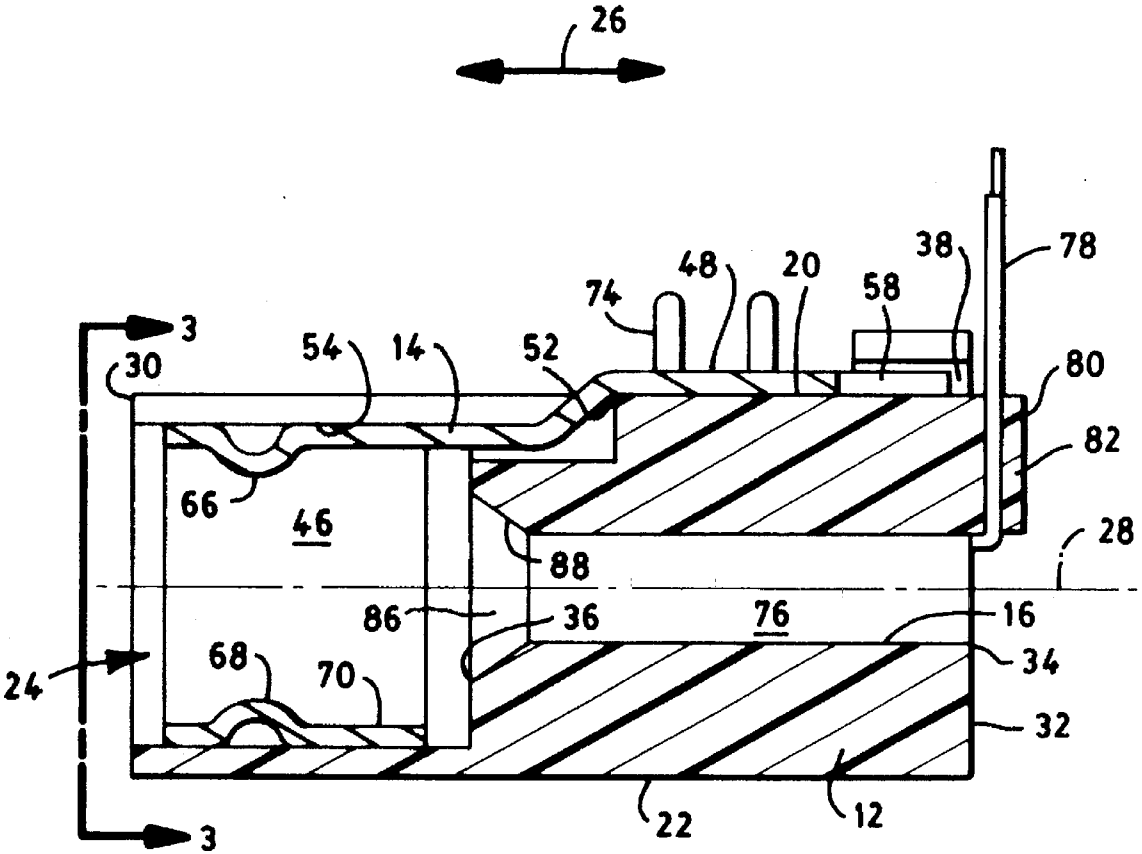
FIG. 2 is a partial section view of FIG. 1, as assembled, taken along lines 2—2.
Figure 3:
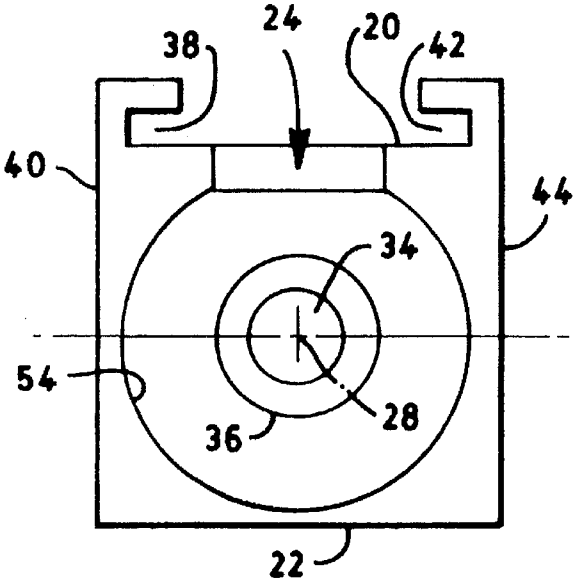
FIG. 3 is an end view of FIG. 2 taken along lines 3—3, with the contact and conductive shell included in FIG. 2 removed.

The embodiment of this invention which is illustrated in FIGS. 1 to 3 is particularly suited for achieving the objects of this invention. FIGS. 1 to 3 depict a connector 10 comprising an insulative housing 12, a conductive connector shell 14 and a contact 16. In the embodiments of FIGS. 1 to 3, contact 16 is in the form of a female contact comprising a ferrule 18 into which a male contact prong may be inserted in the usual manner. It will be readily apparent to those having ordinary skill in the art, however, that contact 16 may be a male contact having a conventional prong for mating with a female contact in the usual manner.

The insulative housing 12 comprises an upper surface 20 and an opposite lower surface 22. A cavity 24 extends into the insulative housing 12 from surface 20 towards the opposite surface 22. The cavity 24 extends in the direction 26 of a longitudinal axis 28 of the insulative housing 12 from a housing end 30 towards an opposite housing end 32. A bore 34 extends into the insulative housing 12 in the direction 26 from end 32 towards end 30. The bore 34 opens into cavity 24 at 36 as depicted in FIG. 2. Upper surface 20 of the insulative housing 12 comprises at least one slot which extends in the direction 26 and is positioned between the cavity 24 and the end 32. In the embodiment of FIGS. 1 to 3 there are two such slots. In particular, one slot 38 is provided at one side 40 of the insulative housing 12 and another slot 42 is provided spaced from slot 38 and positioned at an opposite side 44.

The conductive connector shell comprises a first segment and a second segment extending from the first segment, the first segment being positioned in the cavity of the insulative housing and the second segment extending out of such cavity and into one or more slots of the insulative housing. For example, in the embodiment of FIGS. 1 to 3, the conductive shell 14 comprises a first segment in the form of a split ring 46 and a second segment in the form of a plate 48 extending from a peripheral edge 50 of the split ring. The conductive shell may be fabricated from resilient metal to facilitate assembly as described herein. The split ring 46 is positioned in the cavity 24. The plate 48 extends towards end 32, out of cavity 24 at 52 and into the slots 38 and 42. For example, in the embodiment of FIGS. 1 to 3, the cavity 24 comprises a circular portion 54 with which the split ring 46 mates, and the plate 48 mates with slots 38 and 42. To this end, the plate 48 comprises a distal end 56 relative to the split ring 46. A leg 58 and a leg 60 extend in longitudinal direction 26 from distal end 56 towards end 32 of the insulative housing 12. Legs 58 and 60 are spaced from each other and positioned adjacent respective edges 62 and 64 of the plate 48. When the connector 10 is assembled as depicted in FIG. 2, the leg 58 will extend into slot 38 and the leg 60 will extend into the slot 42.

In the preferred embodiment the first segment of the conductive shell 14 comprises at least one protuberance which extends from the first segment towards longitudinal axis 28. For example in the embodiment of FIGS. 1 to 3, the split ring 46 comprises two protuberances 66 and 68 which extend from an inner surface 70 of the split ring 46 towards longitudinal axis 28 as best seen in FIG. 2.

In the preferred embodiment, the second segment of the conductive shell comprises at least one tab extending away from a surface of the insulative housing. For example, in the embodiment of FIGS. 1 to 3, the plate 48 comprises two tabs 72 and 74 which extend away from surface 20.

Contact 16 comprises a first portion 76 and a second portion 78 extending therefrom. The first portion is positioned in bore 34 and the second portion extends from such bore at end 32 of the insulative housing 12. As noted, contact 16 is depicted as a female contact in the form of a ferrule 18. In those instances where contact 16 is a male contact, a conventional male prong will extend in the direction 26 away from the first portion 76, into cavity 24 and towards end 30 of the insulative housing 12 as depicted in the embodiment of FIGS. 4 to 6 to be described hereinafter.

In the embodiment of FIGS. 1 to 3, the end 32 comprises a protruding portion 80 having a groove 82 which extends in a radial direction 84 relative to longitudinal axis 28. In the assembled embodiment depicted in FIG. 2, the second portion 78 of the contact 16 has been bent such that such second portion extends through groove 82 and away from longitudinal axis 28 in the radial direction 84.

In assembling the connector 10 of FIGS. 1 to 3, a kit may be provided which comprises the insulative housing 12, the conductive shell 14 and the contact 16. Assembly of the connector includes inserting the contact 16 into bore 34 from end 30 of the housing, and pushing the contact through the bore until the first portion 76 of the contact is positioned in the bore and the flared end 86 of the contact mates with the flared end 88 of the bore. The second portion 78 of the contact 16 will extend from the bore 34 and may be bent until the second portion is positioned in groove 82 as depicted in FIG. 2. The conductive shell may then be inserted into the cavity 24 of the housing 12 from end 30. To this end the resilient, split ring 46 may be deformed such that opposing ends 90 and 92 of the split ring 46 move towards each other to the extent that such split ring may be inserted into the cavity 24, the dimension of the split ring being such that when in place within such cavity the resilience of the split ring will urge ends 90 and 92 away from each other causing the split ring to bear against the mating circular portion 54. Such engagement between the split ring 46 and the circular portion 54 will substantially deter axial movement of the conductive shell 14 relative to the housing 12. While moving the conductive shell 14 into housing 12 in this manner, the legs 58 and 60 will be inserted into respective slots 38 and 42. The engagement between legs 58 and 60 and respective slots 38 and 42 will prevent rotational movement of the conductive shell 14 relative to the housing 12. When a male connector 94 is connected to the female connector 16 in a conventional manner, tactile feedback will be provided by positioning the protuberances 66 and 68 such that they enter a respective opening 96 when the contacts are properly mechanically and electrically coupled together. The presence of protuberances 66 and 68 in respective opening 96 will also prevent rotational and axial movement of the male connector 94 relative to the connector 10. Protuberances 66 and 68 also provide a satisfactory ground vis-à-vis the male connector 94.

Figure 4:
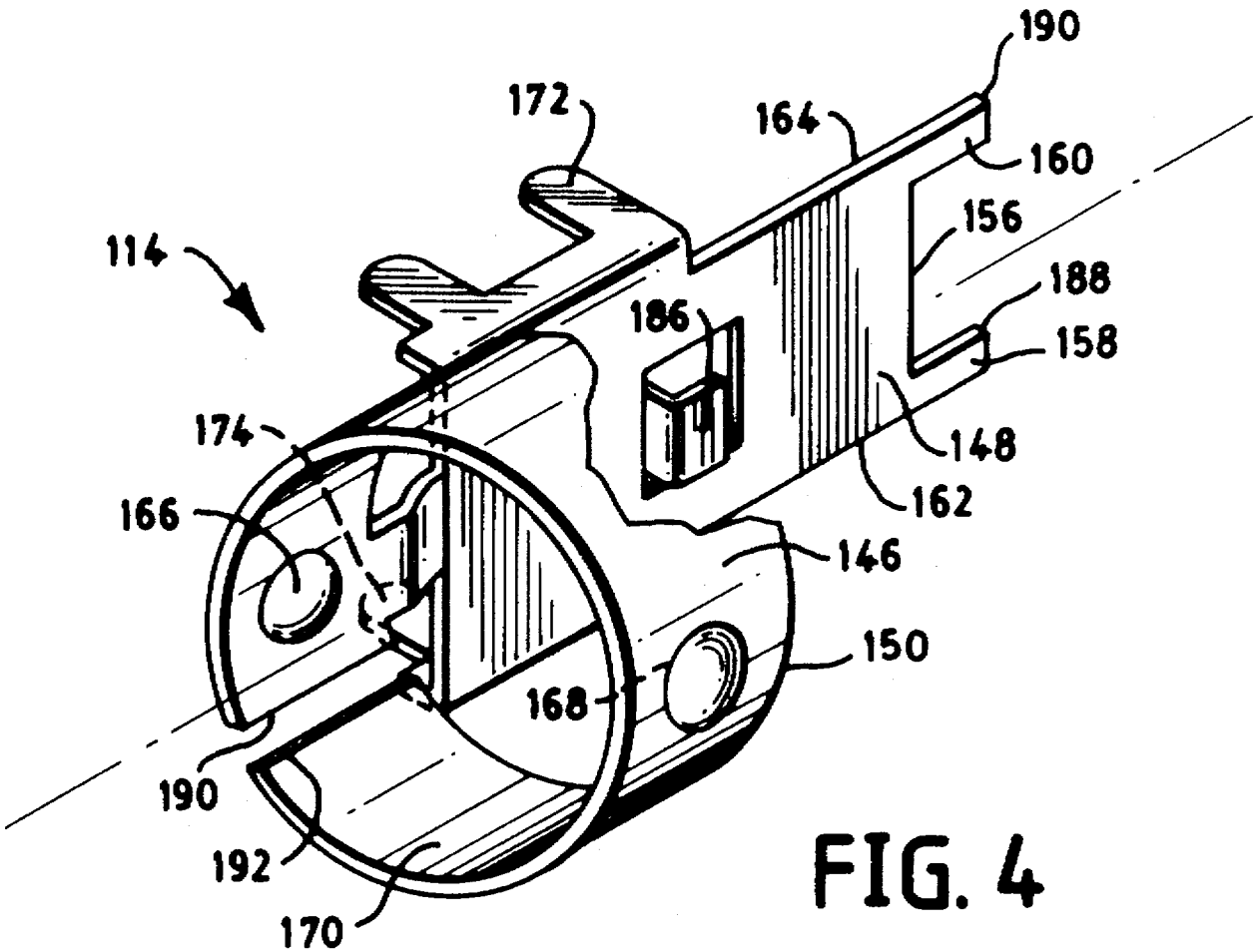
FIG. 4 is a perspective view of a conductive shell of the present invention.
Figure 5:
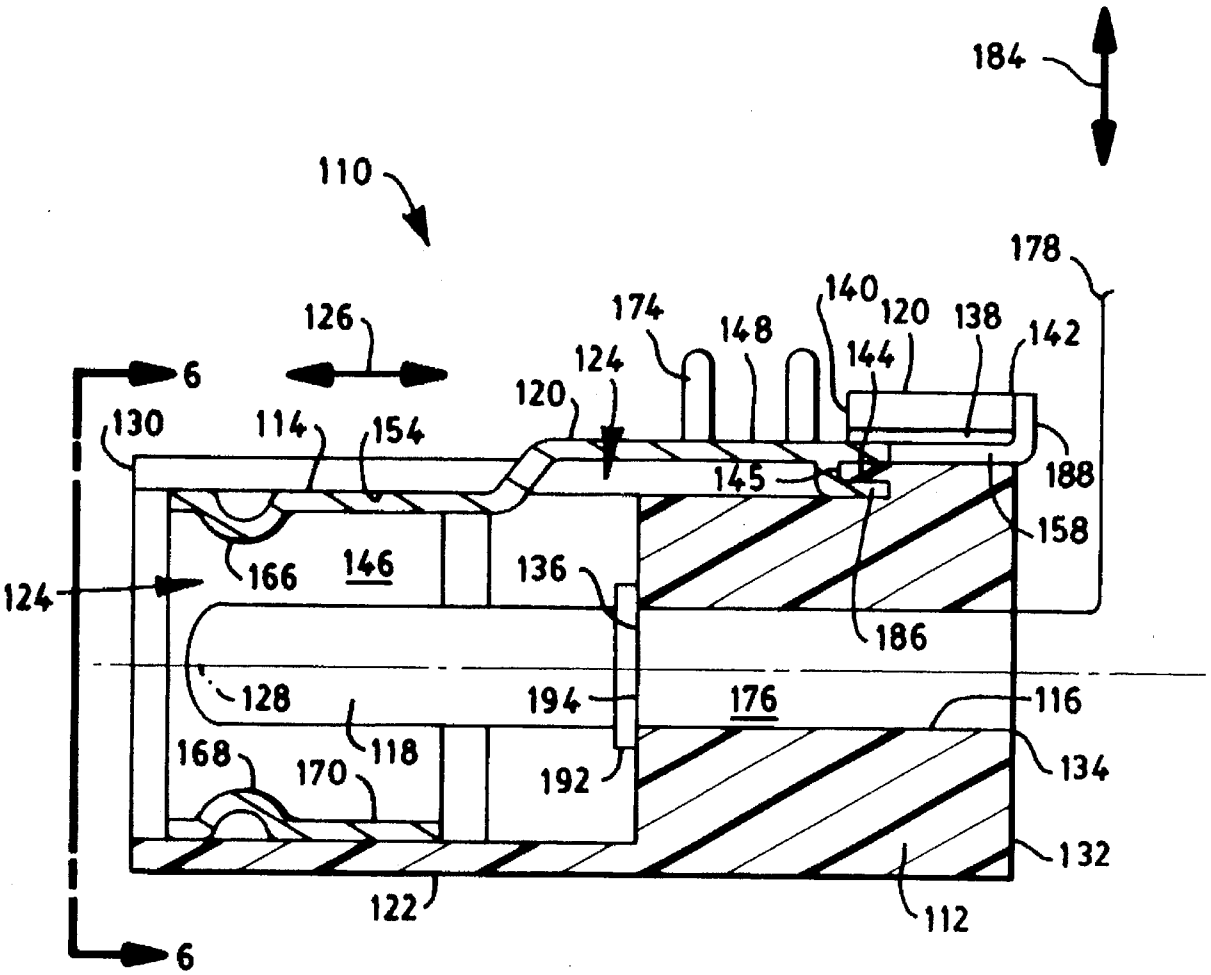
FIG. 5 is a partial section view of an alternative embodiment of the present invention including the conductive shell of FIG. 4.
Figure 6:
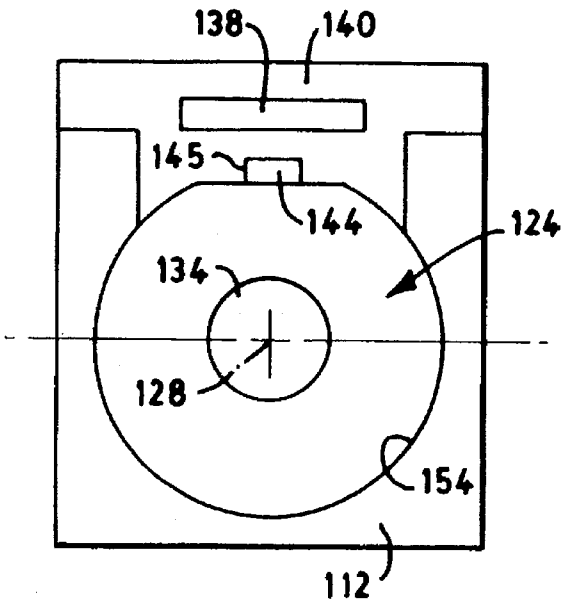
FIG. 6 is an end view of FIG. 5 taken along lines 6—6, with the contact and conductive shell included in FIG. 5 removed.

FIGS. 4 to 6 depict an alternative embodiment of the present invention. The embodiment of FIGS. 4 to 6 is similar to that of FIGS. 1 to 3 except as noted herein. For example, FIGS. 4 to 6 depict a connector 110 which comprises an insulative housing 112, a conductive shell 114 and a contact 116. Contact 116 is depicted in the form of a male contact comprising a male prong 118 which is adapted to be inserted into a female contact in the usual manner. It will be readily apparent to those having ordinary skill in the art, however, that contact 116 may be a female contact of the type depicted in FIGS. 1 to 3.

The insulative housing 112 comprises an upper surface 120 and an opposite lower surface 122. A cavity 124 extends into the insulative housing 112 from surface 120 towards the opposite surface 122. The cavity 124 extends in the direction 126 of a longitudinal axis 128 of the insulative housing 112 from a housing end 130 towards an opposite housing end 132. A bore 134 extends into the insulative housing 112 in the direction 126 from end 132 towards end 130. The bore 134 opens into cavity 124 at 136 as depicted in FIG. 5. The embodiment of FIGS. 4 to 6 differs from that of FIGS. 1 to 3 in that upper surface 120 of the insulative housing 112 comprises a single enclosed slot 138. Slot 138 extends in the direction 126 and is positioned between the cavity 124 and the end 132. Slot 138 extends from a slot end 140 which is adjacent cavity 124 to a slot end 142 which is adjacent end 132 of the insulative housing 112. The embodiment of FIGS. 4 to 6 is further distinct from that of FIGS. 1 to 3 in that the insulative housing 112 comprises a hole 144 positioned between cavity 124 and end 132. The hole 144 opens up into cavity 124 at 145.

The conductive shell 114 comprises a first segment and a second segment extending from the first segment, the first segment being positioned in the cavity of the insulative housing and the second segment extending out of such cavity and into a slot of the insulative housing. For example, in the embodiment of FIGS. 4 TO 6, the conductive shell 114 comprises a first segment in the form of a split ring 146 and a second segment in the form of a plate 148 extending from a peripheral edge 150 of the split ring. The plate 148 extends towards end 132 of the insulative housing 112. The split ring 146 is positioned in the cavity 124. The plate 148 extends out of cavity 124 and into the slot 138. For example, the cavity 124 comprises a circular portion 154 with which the split ring 146 mates, and the plate 148 mates with slot 138. To this end, the plate 148 comprises a distal end 156 relative to the split ring 146. A leg 158 and a leg 160 extend in longitudinal direction 126 from distal end 156 towards end 132 of the insulative housing 112. Legs 158 and 160 are spaced from each other and positioned adjacent respective edges 162 and 164 of the plate 148. When the connector 110 is assembled as depicted in FIG. 5, the legs 158 and 160 will extend into slot 138.

In the preferred embodiment, the first segment of the conductive shell 114 comprises at least one protuberance which extends from the first segment towards longitudinal axis 128. For example, in the embodiment of FIGS. 4 to 6, the split ring 146 comprises two protuberances 166 and 168 which extend from an inner surface 170 of the split ring 146 towards longitudinal axis 128 as best seen in FIG. 5.

In the preferred embodiment, the second segment of the conductive shell comprises at least one tab extending away from a surface of the insulative housing. For example, in the embodiment of FIGS. 4 to 6, the plate 148 comprises two tabs 172 and 174 which extend away from surface 120.

Contact 116 comprises a first portion 176 and a second portion 178 extending therefrom. The first portion is positioned in bore 134 and the second portion extends from such bore at end 132 of the insulative housing 112.

The embodiment of FIGS. 4 to 6 does not include a groove similar to groove 82 of the embodiment of FIGS. 1 to 3, although such a groove may be provided if desired.

The plate 148 of the conductive shell 114 of the embodiment of FIGS. 4 to 6 differs from plate 48 of the embodiment of FIGS. 1 to 3 in that plate 148 comprises an angled protuberance 186 which extends from a surface of the plate as best seen in FIG. 4. In the assembled connector 110, the angled protuberance 186 extends into the hole 144. Such angled protuberance facilitates holding the conductive shell 114 in place relative to the insulative housing 112. To this end, a distal end 188 of leg 158 and a distal end 190 of leg 160 may be bent in a radial direction 184 relative to longitudinal axis 128 at a position where such distal ends are adjacent end 132 of the insulative housing. In this manner, the conductive shell 114 is locked in place relative to the insulative bushing 112 by the engagement of the angled protuberance 186 with the hole 144 and the engagement of the distal ends 188 and 190 with the end 132 of the insulative bushing 112.

In assembling the connector 10 of FIGS. 4 to 6, a kit may be provided which comprises the insulative housing 112, the conductive shell 114 and the contact 116. Assembly of the connector includes inserting the contact 116 into bore 134 from end 130 of the housing, and pushing the contact through the bore until the first portion 176 of the contact is positioned in the bore and the flanged portion 192 of the contact abuts the housing 112 at the end 194 of the bore. The second portion 178 of the contact 116 will extend from the bore 134 and may be bent until the second portion is positioned radially relative to axis 128 as depicted in FIG. 5. The conductive shell 114 may then be inserted into the cavity 124 of the housing 112 from end 130. To this end the resilient split ring 146 may be deformed such that opposing ends 190 and 192 of the split ring 146 move towards each other to the extent that such split ring may be inserted into the cavity 124, the dimension of the split ring being such that when in place within such cavity, the resilience of the split ring will urge ends 190 and 192 away from each other causing the split ring to bear against the mating circular portion 154. While moving the conductive shell 114 into housing 112 in this manner, the legs 158 and 160 will be inserted into slot 138 and the angled protuberance 186 will be inserted into hole 144. The distal ends 188 and 190 of legs 158 and 160 may then be bent radially as described herein and depicted in FIG. 5. The engagement between the distal ends 188 and 190 of legs 158 and 160 and the end 132 of the housing 112, and the engagement of angled protuberance 186 and hole 145, will prevent rotational and axial movement of the conductive shell 114 relative to the housing 112.

Fabrication of the various components described herein may be accomplished using conventional procedures. For example, the insulative housing may be molded from a plastic material. The conductive members including male and female contacts and connector shell may be stamped from a metal sheet and then rolled and/or bent if required to form the desired configuration.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector comprising:

an insulative housing having a first surface, an opposite second surface, a cavity extending into said insulative housing from said first surface towards said opposite second surface, said cavity further extending in the direction of a longitudinal axis of said housing from a first end of said housing towards an opposite second end of said housing, and a bore extending into said housing in the direction of said longitudinal axis from said opposite second end towards said first end, said bore opening into said cavity, said first surface comprising at least one slot which extends in the direction of said longitudinal axis and is positioned between said opposite second end and said cavity;

a conductive shell comprising a first segment and a second segment extending from said first segment, said first segment being positioned in said cavity and said second segment extending out of said cavity and into said at least one slot; and a contact comprising a first portion and a second portion extending from said first portion, said first portion being positioned in said bore and said second portion extending from said bore at said opposite second end.

2. The connector of claim 1 wherein said first segment comprises a split ring and said second segment comprises a plate extending from a peripheral edge of said split ring towards said opposite second end, said cavity mating with said split ring and said at least one slot mating with said plate.

3. The connector of claim 2 wherein said plate comprises at least one tab extending away from said first surface.

4. The connector of claim 2 wherein said plate comprises a distal end relative to said split ring, a first leg extending in said longitudinal direction from said distal end, and a second leg, spaced from said first leg, extending in said longitudinal direction from said distal end.

5. The connector of claim 4 wherein said at least one slot comprises a first slot and a second slot spaced from said first slot, said first leg extending into said first slot and said second leg extending into said second slot.

6. The connector of claim 1 wherein said first segment comprises at least one protuberance extending from said first segment towards said longitudinal axis.

7. The connector of claim 1 wherein said opposite second end comprises a groove which extends in a radial direction relative to said longitudinal axis, said second portion of said contact extending through said groove away from said longitudinal axis in said radial direction.

8. The connector of claim 1 wherein said second segment comprises an angled protuberance, and further wherein said insulative housing comprises a hole positioned between said cavity and said opposite second end, said angled protuberance extending into said hole.

9. The connector of claim 8 wherein said first segment comprises a split ring and said second segment comprises a plate extending from a peripheral edge of said split ring towards said opposite second end, said cavity mating with said split ring and said at least one slot mating with said plate.

10. The connector of claim 9 wherein said plate comprises a distal end relative to said split ring, a first leg extending in said longitudinal direction from said distal end, and a second leg, spaced from said first leg, extending in said longitudinal direction from said distal end.

11. The connector of claim 10 wherein at least a portion of a distal end of said first leg and a distal end of said second leg is adjacent said opposite second end and extends away from said longitudinal axis.

12. A connector kit, comprising:

an insulative housing having a first surface, an opposite second surface, a cavity extending into said insulative housing from said first surface towards said opposite second surface, said cavity further extending in the direction of a longitudinal axis of said housing from a first end of said housing towards an opposite second end of said housing, and a bore extending into said housing in the direction of said longitudinal axis from said opposite second end towards said first end, said bore opening into said cavity, said first surface comprising at least one slot which extends in the direction of said longitudinal axis and is positioned between said opposite second end and said cavity;

a conductive shell comprising a first segment and a second segment extending from said first segment, said first segment being adapted for insertion into said cavity and said second segment being adapted for extension out of said cavity and into said at least one slot; and a contact comprising a first portion and a second portion extending from said first portion, said first portion being adapted for insertion into said bore and said second portion being adapted for extension from said bore at said opposite second end.

13. The connector kit of claim 12 wherein said first segment comprises a split ring and said second segment comprises a plate extending from a peripheral edge of said split ring towards said opposite second end, said cavity being configured to mate with said split ring and said at least one slot being configured to mate with said plate.

14. The connector kit of claim 13 wherein said plate comprises at least one tab adapted to extend away from said first surface when said plate is mated with said at least one slot.

15. The connector of claim 13 wherein said plate comprises a distal end relative to said split ring, a first leg extending in said longitudinal direction from said distal end, and a second leg, spaced from said first leg, extending in said longitudinal direction from said distal end.

16. The connector of claim 15 wherein said at least one slot comprises a first slot and a second slot spaced from said first slot, said first leg being adapted to extend into said first slot and said second leg being adapted to extend into said second slot.

17. The connector of claim 12 wherein said first segment comprises at least one protuberance extending from said first segment towards an axis of said first segment.

18. The connector of claim 12 wherein said opposite second end comprises a groove which extends in a radial direction relative to said longitudinal axis, said second portion of said contact being adapted to extend through said groove away from said longitudinal axis in said radial direction.

19. The connector of claim 12 wherein said second segment comprises an angled protuberance, and further wherein said insulative housing comprises a hole positioned between said cavity and said opposite second end, said angled protuberance being adapted to extend into said hole.

20. The connector of claim 19 wherein a distal end of said first leg and a distal end of said second leg are adapted to be positioned adjacent said opposite second end and to extend away from said longitudinal axis.

* * * * *